US011771298B2

(12) United States Patent
Stevens et al.

(10) Patent No.: US 11,771,298 B2
(45) Date of Patent: Oct. 3, 2023

(54) ULTRASONIC CLEANING APPARATUS

(71) Applicant: RealmThree Ltd, Dartford (GB)

(72) Inventors: Matthew Stevens, Dartford (GB); Deborah Stevens, Dartford (GB)

(73) Assignee: RealmThree Ltd, Dartford (GB)

( * ) Notice: Subject to any disclaimer, the term of this patent is extended or adjusted under 35 U.S.C. 154(b) by 776 days.

(21) Appl. No.: 16/681,087

(22) Filed: Nov. 12, 2019

(65) Prior Publication Data

US 2020/0196827 A1 Jun. 25, 2020

(30) Foreign Application Priority Data

Dec. 21, 2018 (GB) ..... 1821018
Jul. 12, 2019 (GB) ..... 1910071

(51) Int. Cl.
*A47L 15/42* (2006.01)
*B08B 3/12* (2006.01)
*A47L 15/00* (2006.01)

(52) U.S. Cl.
CPC ..... *A47L 15/0007* (2013.01); *A47L 15/0089* (2013.01); *A47L 15/4214* (2013.01);
(Continued)

(58) Field of Classification Search
CPC ..... A47L 15/0007; A47L 15/0089; A47L 15/4214; A47L 15/4234; A47L 15/4251; A47L 2601/17
See application file for complete search history.

(56) References Cited

U.S. PATENT DOCUMENTS 4,443,269 A * 4/1984 Capella ..... B08B 3/006 134/25.4
4,589,556 A * 5/1986 Peretz ..... A47L 15/505 211/41.9

(Continued)

FOREIGN PATENT DOCUMENTS

CN 201375968 Y 1/2010
CN 206689138 U 12/2017

(Continued)

OTHER PUBLICATIONS

Search Report for Application No. GB1821018.7 dated Jan. 29, 2019, 1 page.

(Continued)

*Primary Examiner* — Joseph L. Perrin
*Assistant Examiner* — Irina Graf
(74) *Attorney, Agent, or Firm* — Wood, Phillips, Katz, Clark & Mortimer

(57) ABSTRACT

An ultrasonic cleaning apparatus with a cleaning reservoir having a plurality of chambers, which are selectably fillable with cleaning fluid. The chambers of the multi-chamber reservoir are fluidly interconnectable, the apparatus further comprising a fluid distribution pump and a controller for sequentially controlling a fluid flow between the chambers during an ultrasonic cleaning cycle. Such a multi-chamber reservoir has the advantage of reducing the total volume of fluid required to clean vessels in the reservoir, since the cleaning process can be performed in a staged or sequential procedure, and the cleaning and/or rinsing fluid reused in each chamber, allowing the apparatus to be more compact.

14 Claims, 3 Drawing Sheets

(52) U.S. Cl.
CPC ..... *A47L 15/4234* (2013.01); *A47L 15/4251* (2013.01); *A47L 2601/17* (2013.01)

(56) References Cited

U.S. PATENT DOCUMENTS

| | | | | |
|---|---|---|---|---|
| 4,881,561 | A * | 11/1989 | Schwarzwalder | B05B 15/555 134/76 |
| 5,501,240 | A * | 3/1996 | Dohku | B08B 3/02 134/102.2 |
| 2003/0131873 | A1* | 7/2003 | Gray | B08B 3/12 134/108 |
| 2013/0220478 | A1* | 8/2013 | Kasahara | B65B 3/04 141/2 |
| 2013/0334940 | A1* | 12/2013 | Lundberg | A47L 15/4263 312/228 |
| 2013/0340790 | A1* | 12/2013 | Lemley | A47L 15/502 134/1 |
| 2016/0338567 | A1* | 11/2016 | Kong | A47L 15/0002 |
| 2017/0065145 | A1* | 3/2017 | Dallal | A47L 15/0089 |
| 2019/0291147 | A1* | 9/2019 | Crimston | B08B 3/026 |

FOREIGN PATENT DOCUMENTS

| | | | |
|---|---|---|---|
| CN | 208019052 | U | 10/2018 |
| GB | 2107685 | A | 5/1983 |
| GB | 2122980 | A | 1/1984 |
| JP | H0531468 | A | 2/1993 |

OTHER PUBLICATIONS

Search Report for Application No. GB1910071.8 dated Aug. 28, 2019, 1 page.

* cited by examiner

ULTRASONIC CLEANING APPARATUS

BACKGROUND OF THE INVENTION

This invention relates to an ultrasonic cleaning apparatus and in particular to an apparatus for cleaning vessels, especially bottles. The apparatus is particularly useful for cleaning infant feeding bottles, and other infant articles.

BRIEF SUMMARY OF THE INVENTION

When infants are bottle-fed, many hours are spent washing and rinsing the bottles at a sink or by stacking the various parts of the bottles into a dishwasher to clean them. The bottles and their various parts are then manually rinsed and placed in a steriliser for a predetermined duration to ensure that any bacteria are killed.

The use of a conventional washing, rinsing and sterilizing process is a laborious procedure, and the bottles are repeatedly handled at each stage, risking contamination.

Dishwashers tend to leave stains on bottles and teats, and often the water jets in the dishwasher push the teats and bottles onto their sides, resulting in dirty water being left inside and unsatisfactory cleaning results.

Not only is the whole procedure time-consuming, but a large amount of water and chemical treatments are required for the washing and sterilizing steps. This is not only an issue for infant bottles, but also for other applications in which equipment must be sterilized, in particular in the medical and scientific fields.

There is a need for a cleaning apparatus which can wash, rinse, and optionally sterilize bottles, such as infant bottles, with a more efficient use of cleaning fluid.

It is also an object of this invention to provide an apparatus that is sufficiently compact to be used as a portable table-top apparatus.

The present invention satisfies these objects by providing an ultrasonic cleaning apparatus with a cleaning reservoir having a plurality of chambers, which are selectably fillable with cleaning fluid. The chambers of the multi-chamber reservoir are fluidly interconnectable, the apparatus further comprising a controller for sequentially controlling a fluid flow between the chambers during an ultrasonic cleaning cycle.

Such a multi-chamber reservoir has the advantage of reducing the total volume of fluid required to clean vessels in the reservoir, since the cleaning process can be performed in a staged or sequential procedure, and the cleaning and/or rinsing fluid reused in each chamber.

Thus, a smaller volume of cleaning fluid and waste fluid needs to be stored in the apparatus, which can therefore be more compact.

Accordingly, the present invention provides an ultrasonic cleaning apparatus comprising: a cleaning reservoir having a plurality of chambers for holding a cleaning fluid; at least one ultrasonic generator adapted to impart ultrasonic vibrations to the chambers of the cleaning reservoir; a fluid-distribution pump configured to transfer cleaning fluid between the chambers of the cleaning reservoir; and a controller for activating the fluid-distribution pump to sequentially transfer the cleaning fluid between the chambers of the cleaning reservoir.

Optionally, the fluid-distribution pump may be an air suction pump to create a vacuum pressure for transferring the cleaning fluid between the chambers of the cleaning reservoir.

The advantage of the multi-chamber apparatus is that the amount of cleaning fluid required to fill a single chamber is sufficient to perform all ultrasonic cleaning cycles. The apparatus is able to transfer the cleaning fluid from one chamber to another for subsequent cleaning without risk of contamination of the cleaning fluid by contact with a pump directly.

The cleaning reservoir may suitably contain from 2 to 10 chambers, for example from 2 to 5 chambers. Preferably, the reservoir contains 2 chambers. The chambers may optionally be releasable within the reservoir.

At least one ultrasonic generator is provided to impart ultrasonic vibrations to cleaning fluid in the cleaning reservoir. Preferably one ultrasonic generator is provided per chamber. The ultrasonic generators are preferably mounted within a base of the apparatus for stability.

The apparatus may further comprise a lid having a seal to air-tightly seal the cleaning reservoir.

In a preferred aspect of this invention, the cleaning apparatus further comprises at least one conduit having an open end which extends into the cleaning reservoir; and an air extraction means associated with the conduit for providing an air escape pathway via the open end to remove air trapped in an inverted vessel to be cleaned when positioned on the conduit inside the cleaning reservoir.

The use of conduits as mounts for vessels to be cleaned, in particular for infant bottles and teats, allows for the air inside the vessels to be removed as the cleaning reservoir is filled. This ensures that all internal surfaces of the vessels are in contact with the cleaning fluid, and therefore ultrasonic vibrations are transmitted to the internal surfaces far more effectively than through air. This results in a more efficient cleaning process.

Suitably, a plurality of said conduits is provided. The conduits may be situated in one or more of the chambers of the reservoir. For example, at least one conduit may be provided in each chamber of the reservoir. Alternatively, some chambers may not contain a conduit, as a conduit is not necessary in chambers suitable for dummies, teething rings and feeding spoons. Suitably, chambers that contain conduits have at least 1 conduit in a chamber, for example from 1 to 10 conduits in a chamber, preferably 2 or 3 conduits in a chamber.

Optionally, the open ends of the conduits may be vertically displaced relative to one another in the cleaning reservoir. Vertical displacement of the open ends allows for many more vessels to be inserted into the cleaning reservoir, since the internal volume thereof is used in a much more efficient manner.

The conduits of the present invention may extend up through the bases of the cleaning reservoir chambers, or through the sides. Alternatively, the conduit pathway could extend up the side of each chamber, in through the top of the chamber, and then into an upstanding configuration to receive vessels. In such an arrangement, it is preferred that the conduit does not touch the chamber wall, so that the conduit does not reduce the amount of ultrasonic movement. The seal of the lid could be arranged to accommodate this alternative arrangement.

Preferably, the upstanding open end of each conduit is bevelled or chamfered to present a pointed or non-horizontal face upon which a vessel can be positioned. Each conduit may be differently positioned and/or dimensioned. For instance, the open ends of the conduits may be vertically spaced apart so that vessels may be spaced throughout the cleaning reservoir. For example, larger conduits which are positioned closer to the base of the cleaning reservoir may be provided for mounting larger or taller bottles, whilst taller and/or narrower conduits may be provided for shorter or smaller bottles or teats.

When a cleaning chamber is filled with cleaning fluid, there is a propensity for the vessels to lift from the open ends of the conduits, due to the air trapped within. To prevent this, it is preferred that at least one retaining member be provided which is contactable with the inverted vessel to be cleaned to inhibit lift from the conduit.

This retaining member could be provided as an insertable grid, for example, which is particularly useful for positioning within the chamber to contact vessels on lower conduits. Alternatively, a lid of the cleaning reservoir, and/or the lid of the apparatus could be provided with a dedicated retaining member, which would be designed to contact the higher vessels.

In addition, trapped air in the vessels may cause lift when the cleaning fluid is introduced into the cleaning reservoir, which may then negate the suction capabilities of the apparatus before the suction generator is activated. A retaining member negates this issue.

A biasing element may be provided which is associated with the retaining member and which is positioned to correspond with the conduit. Biasing elements allow for vessels of different sizes to positioned on conduits of the same height without risking lifting of smaller vessels. As such, the utility of the ultrasonic cleaning apparatus is significantly increased.

The biasing elements may comprise, for example springs or foam pads. They can be associated with the open ends of the conduits when the retaining member is in position and may preferably tilt the vessels in use, so that the open ends of each conduit are in contact with an uppermost internal volume of the vessels for optimised air extraction.

The apparatus may further comprise a cleaning fluid tank for storing cleaning fluid prior to distribution into the cleaning reservoir, and a used fluid tank for storing cleaning fluid removed from the cleaning reservoir following ultrasonic cleaning. These tanks may be stored in one or more access compartments within the apparatus.

Although the present apparatus could be plumbed directly into a mains water supply and waste-water drainage system, removable tanks allow for the ready insertion of clean water and removal of dirty water following the ultrasonic cleaning process, avoiding the need to implement plumbing arrangements.

Additionally, there may be a fluid-distribution pump for distributing cleaning fluid between the cleaning fluid tank, cleaning reservoir, and used fluid tank. The fluid-distribution pump may be a water pump, or alternatively may be an air suction pump.

The use of a fluid-distribution pump can be provided in such a way as to create fluid flow within the cleaning reservoir. In particular, the use of an air suction pump to create pressure differentials via vacuum generation allows for the cleaning fluid to be distributed through the apparatus without contacting the dirty components of the pump.

A cleaning-additive insertion means may be provided for inserting one or more cleaning additives into the cleaning reservoir.

It is preferred that dosing means can be added into the cleaning fluid based on a user's requirements, for instance, detergent, since this provides a much wider variety of options for the cleaning procedure.

Optionally, the air extraction means comprises a suction generator to provide suction at the open end of the conduit to remove air from the inverted vessel.

A suction generator provides a suitable and straightforward mechanical means of removing the air from the vessels without significant risk of back contamination.

It will be apparent that a single pump could be provided to perform the tasks of both the suction generator and the fluid-distribution pump.

Preferably, the air extraction means may comprise an air vent which is positioned at or adjacent a top side of the apparatus to permit gravitational expulsion of air during filling of the cleaning reservoir with cleaning fluid.

A, preferably switchable, air vent may allow for gravitational drainage of a final cleaning reservoir in sequence, if the used fluid tank is positioned below the final cleaning reservoir, since there is an air escape route, which may in turn reduce the power consumed by the suction generator as fluid is diverted through the apparatus.

In a preferred embodiment, there may be provided a steam generator for generating steam to sterilise the inverted vessel to be cleaned following ultrasonic cleaning.

Sterilization of the vessels is very useful for the cleaning of infant bottles in order to kill bacteria, or fungal growth which may be present on any milk or formula residue thereon. The provision of a steam generator allows both cleaning and sterilization by a single apparatus and therefore greatly simplifies the process of arriving at a set of clean and sterile infant bottles.

The steam generator may be in the form of a separate heating tank containing a heating element. The heating tank may be connected to the fresh water/cleaning fluid tank via non-return valve. In this case, following the ultrasonic cleaning process, the water in the heating tank is heated to create steam and the generated steam is introduced into the cleaning chambers.

Optionally, the steam generator may also be associated with the conduit, the steam being directed through the conduit into the inverted vessel to be cleaned. The direction of the steam through the conduits advantageously allows for sterilization of the internal surfaces of the vessel, which is best performed immediately after complete sanitization of the internal surfaces.

The heating tank may also be employed to merely warm the water flowing through it as it enters the first chamber for the ultrasonic cleaning process; and again, as part of the rinsing process.

The sealing of the cleaning reservoir with an air-tight lid provides a barrier to introduction of airborne bacteria, viruses, or other particles which might contaminate the vessels which have been cleaned. As such, the cleaned and sterile vessels can be stored in the apparatus until required. Individual seals may be provided for each chamber in the cleaning reservoir, and this may provide the necessary sealing to permit pressure differentials to form between chambers.

There may also be provided a fill-status sensor associated with the cleaning reservoir.

The presence of a fill-status sensor allows for greater automation of the process of cleaning, since the ultrasonic cleaning cycles can be activated immediately on determination of a filled reservoir.

Preferably, a heating element is provided for heating cleaning fluid in or prior to insertion into the cleaning reservoir.

Heated cleaning fluid is advantageous in that it allows for a more effective cleaning process. The heating element could also be used for the generation of steam for sterilization.

The functionality of the cleaning apparatus of this invention may be controlled by a user interface, preferably a digital user interface, on the outside of the apparatus.

The cleaning cycle could activate automatically based on one or more predetermined requirements. For instance, there could be a fill-status sensor associated with the cleaning reservoir which is communicable with a lock of the lid of the apparatus to selectively lock or unlock the lid based on a fill status of the cleaning reservoir, and/or to only activate an ultrasonic generator once sufficient cleaning fluid has been detected. This fill-status sensor could be provided as a simple float sensor, could be an optical sensor arranged to detect a water level, or could feasibly be a load cell which can detect the weight of cleaning fluid in the cleaning reservoir.

In a further aspect of the present invention, there is provided a method of cleaning a vessel, the method comprising the steps of: a] providing a cleaning reservoir having a plurality of chambers for holding a cleaning fluid; b] filling a first chamber of the cleaning reservoir with a cleaning fluid; c] ultrasonically cleaning one or more vessels in the first chamber; d] transferring the cleaning fluid from the first chamber to a second chamber of the cleaning reservoir; and e] ultrasonically cleaning one or more vessels in the second chamber.

The apparatus of this invention can be used for the cleaning of a variety of infant articles, such as infant feeding bottles, teats, dummies, teething rings, and feeding spoons. Furthermore, the apparatus is suitable for cleaning a variety of vessels, in addition to infant bottles, such as laboratory equipment, dental or medical equipment.

BRIEF DESCRIPTION OF THE DRAWINGS

The invention will now be more particularly described, by way of example only, with reference to the accompanying drawings, in which.

DETAILED DESCRIPTION

Figure 1:
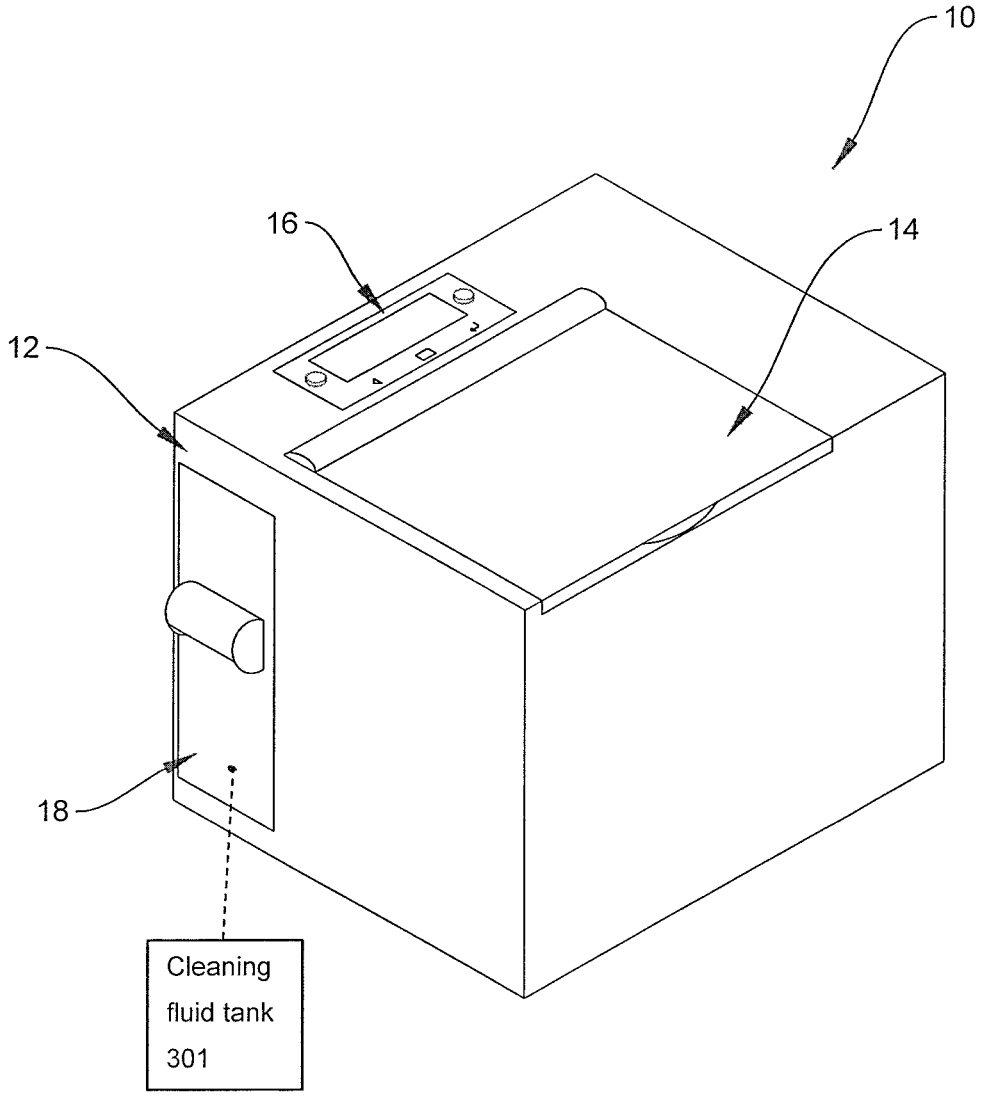
FIG. 1 shows a perspective representation of one embodiment of an ultrasonic cleaning apparatus in accordance with the first aspect of the invention.

Referring to FIG. 1, there is shown an ultrasonic cleaning apparatus, indicated globally at 10 and which is suitable for cleaning vessels such as infant bottles, teats and caps.

The apparatus 10 comprises a housing 12 having a closable lid 14 which has a sealing element to provide an air-tight seal into housing 12. A digital user interface 16, is provided on the upper surface of the housing 12, to enable the functionality of the apparatus 10 to be controlled. An access compartments 18 is provided, to replace fluid for the apparatus as it becomes soiled during the cleaning process.

Figure 2:
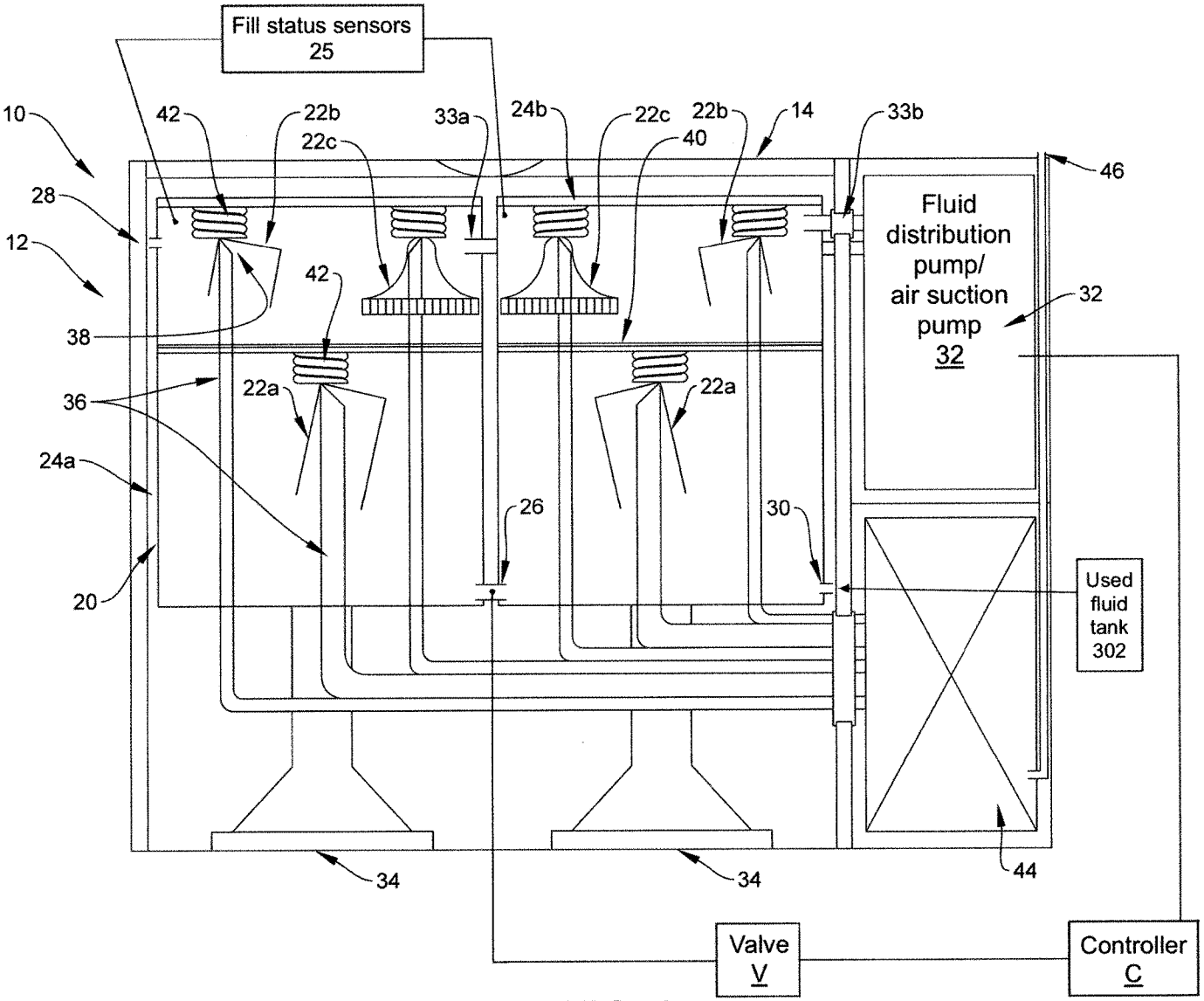
FIG. 2 shows a vertical cross-section through the ultrasonic cleaning apparatus of FIG. 1.
Figure 3:
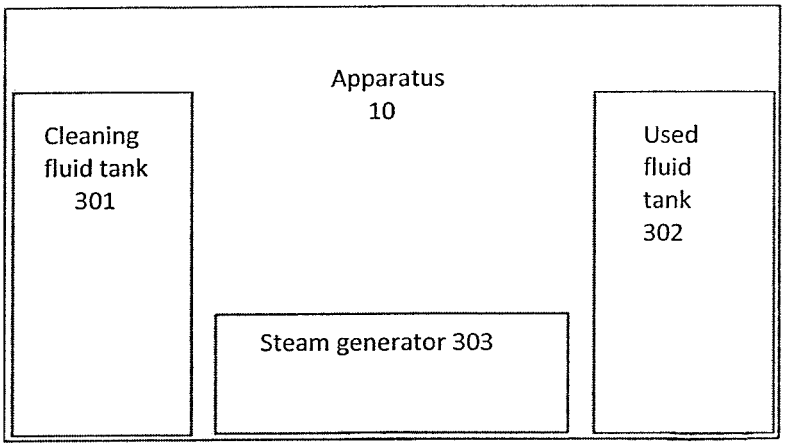
FIG. 3 is a schematic depiction of certain components on the ultrasonic cleaning apparatus.

The internal features of the apparatus 10 are shown in FIG. 2 and FIG. 3. Opening the lid 14 provides access to a cleaning reservoir 20, which receives vessels 22*a*, 22*b*, 22*c* to be cleaned. The cleaning reservoir 20 is releasably engageable with the housing 12, so as to permit easy cleaning thereof by a user.

The cleaning reservoir 20 contains two separate chambers 24*a*, 24*b* which may be selectively filled during use. Fill status sensors 25 are provided in each chamber. The chambers 24*a*, 24*b* are interconnected by a fluid port 26, which has a valve V that is opened and closed by the controller C at the appropriate times in the cleaning process. Each individual chamber 24*a*, 24*b* may be individually sealed, so that pressure differentials between adjacent chambers 24*a*, 24*b* can be generated.

The cleaning reservoir 20 is adapted to be filled with a cleaning fluid, typically water or treated water. The cleaning fluid is introduced into the first chamber 24*a* of the cleaning reservoir 20 via a fluid inlet 28 which is in communication with a cleaning fluid tank 301 for storing cleaning fluid prior to distribution into the first chamber 24*a* of the cleaning reservoir 20. The cleaning fluid tank 301 is situated within the access compartment 18.

A used fluid tank 302 is also provided, which is suitable for storing cleaning fluid removed from the cleaning reservoir 20 following ultrasonic cleaning. The used fluid tank 302 is held within a further access compartment in the side of the housing 12. A dedicated fluid outlet 30 is provided for drainage into the used fluid tank 302.

In order to control the flow of fluid flow in and out of the cleaning reservoir 20, a fluid distribution pump 32 is provided which is in fluid communication with the cleaning fluid tank, used fluid tank, and the cleaning reservoir 20, thereby allowing cleaning fluid to be distributed therebetween and inserted and drained therefrom. A dedicated controller C is provided which is able to activate the correct pumping sequence. In a typical sequence, the valve on port 26 is closed and cleaning fluid is introduced into the first chamber 24*a* via a vacuum, generated by the fluid-distribution pump 32 in the form of an air suction pump. Suction formed by a vacuum in the chambers 24*a*, 24*b* has the advantage of avoiding clean cleaning fluid being cross-contaminated. The vacuum is generated in the second chamber 24*b* via a suction port 33*b* in communication with the fluid-distribution pump 32. A corresponding suction port 33*a* is provided which fluidly interconnects the fluid-distribution pump 32 with the first chamber 24*a*, so that an appropriate suction force can be applied.

To remove the cleaning fluid from the first chamber 24*a*, the valve on fluid port 26 is opened and the fluid-distribution pump creates a vacuum pressure in the second chamber 24*b*, which draws the cleaning fluid into the second chamber 24*b* through the port 26. Drainage of the second chamber 24*b* can be achieved by allowing drainage into a used fluid chamber, either by pumping, or by gravitational drainage.

The cleaning reservoir 20 is intended to be used for the ultrasonic cleaning of vessels 22*a*, 22*b*, 22*c* inserted therein. For that purpose, one ultrasonic generator 34 per chamber 24*a*, 24*b*, is provided to impart ultrasonic vibrations to cleaning fluid in the cleaning reservoir 20. The ultrasonic generators 34 are mounted within a base of the housing 12 for stability.

To mount vessels 22*a*, 22*b*, 22*c*, three mounts are provided vertically within each chamber of the cleaning reservoir 20. Each mount is in the form of a conduit 36, having an upstanding open end 38, which is bevelled to present a pointed face upon which a vessel 22*a*, 22*b*, 22*c* can be positioned.

The conduits 36 are differently positioned and dimensioned. The open ends 38 of the conduits 36 are vertically spaced apart so that vessels 22*a*, 22*b*, 22*c* may be spaced throughout the cleaning reservoir 20. Larger conduits 36 are positioned closer to the base of the cleaning reservoir 20, for mounting larger or taller bottles 22*a*, whilst taller and/or narrower conduits 36 are provided for shorter or smaller bottles 22*b* or teats 22*c*.

A retaining member in the form of an insertable grid 40, is positioned within each chamber 24*a*, 24*b* to contact vessels 22*a* on lower conduits 36. The lid of each chamber is designed to contact and retain the higher vessels 22*b*, 22*c*.

Biasing elements, in the form of springs 42, are provided on the retaining members, and positioned so as to be associated with the open ends 38 of the conduits 36. The open ends 38 of each conduit 36 are in contact with an uppermost internal volume of the vessels 22*a*, 22*b*, 22*c* for optimised air extraction.

The conduits 36 are coupled to an air displacement means, in the form of an air suction pump 44, to provide positive suction to the insides of inverted vessels 22*a*, 22*b*, 22*c* mounted on the open ends 38. As a cleaning chamber 24*a* or 24*b* is filled with cleaning fluid, the suction is applied to draw air out of the vessels 22*a*, 22*b*, 22*c*, so that the cleaning fluid comes into complete contact with the interiors of the vessels 22*a*, 22*b*, 22*c*.

The conduits 36 are connected to an air vent 46 having a switchable closure mechanism. The air vent 46 is provided in conjunction with suction pump 44. In this arrangement, the conduits 36 provide an air escape pathway for air trapped within the vessels 22*a*, 22*b*, 22*c*, with the cleaning fluid displacing the air via the conduits and out of the air vent 46 under gravity.

A steam generator 303 is in the form of a heating tank, containing a heating element and having clean water therein, so that steam is introduced into the cleaning chambers through the fluid inlet 28. The conduits 36 are also coupled to the steam generator 303, so that steam can be introduced direct into the vessels 22*a*, 22*b*, 22*c* to sterilize the inner surfaces thereof.

A typical cleaning cycle of the ultrasonic cleaning apparatus 10 therefore proceeds as follows. The user opens the lid 14 to access the cleaning reservoir 20, and vessels 22*a*, 22*b*, 22*c* are inserted onto the open ends 38 of the conduits 36 in an inverted state. The insertable grid 40 is positioned so as to hold some of the vessels 22*a* in position whilst also providing a platform onto which other items, particularly those without cavities such as locking rings for teats 22*c*, may be positioned. Upon closure of the lid 14, the relevant retaining member will also hold any other vessels 22*b*, 22*c* in position.

The cleaning fluid tank 301 is first filled. Cleaning fluid, optionally dosed with additive, is introduced via fluid inlet 28 into the first chamber 24*a* to the exclusion of the second chamber 24*b*. As the cleaning fluid fills the first chamber 24*a*, air is sucked out of the vessels 22*a*, 22*b*, 22*c* by the suction generator 44. This reduces the risk of air pockets being formed within the vessels 22*a*, 22*b*, 22*c*.

The cleaning fluid may be heated to a desired temperature in the heating tank. The ultrasonic generator 34 associated with the first chamber 24*a* is then activated to initiate a first ultrasonic cleaning cycle.

Once the first ultrasonic cleaning cycle is complete, the fluid-distribution pump 32 is activated so as to create a vacuum or pressure differential within the second chamber 24*b*, such that cleaning fluid is drawn from the first chamber 24*a* into the second chamber 24*b*, via the fluid port 26. This avoids the cleaning fluid from being contaminated by contact with the fluid-distribution pump 32 directly, allowing the cleaning fluid to be reused for the vessels 22*a*, 22*b*, 22*c* in the second chamber 24*b*.

The ultrasonic generator 34 associated with the second chamber 24*b* is then activated to start a second ultrasonic cleaning cycle. Once complete, the soiled cleaning fluid is then drained into the used fluid tank 302.

Concurrently with, or subsequent to, the second ultrasonic cleaning cycle, a first ultrasonic rinsing cycle is performed in the first chamber 24*a*. Clean water or similar rinsing fluid is introduced into the first chamber 24*a*, the ultrasonic generator 34 activated, and the vessels 22*a*, 22*b*, 22*c* rinsed via ultrasonic means. Air pockets in the vessels 22*a*, 22*b*, 22*c* are again removed via the conduits 36.

Once the first ultrasonic rinsing cycle is complete, a second ultrasonic rinsing cycle is effected, by drawing of the rinsing fluid from the first chamber 24*a* into the second chamber 24*b* using the fluid-distribution pump 32. The rinsing fluid is then also discarded into the used fluid tank 302.

Following rinsing of the vessels 22*a*, 22*b*, 22*c*, an optional sterilization step can occur. This could be performed by chemical dosing and further ultrasonic treatment of the vessels 22*a*, 22*b*, 22*c*. However, it is preferred that sterilization is achieved by steaming the vessels 22*a*, 22*b*, 22*c*, introducing steam from the steam generator 303 via the conduits 36 so as to prioritize sterilization of the inner surfaces of the vessels 22*a*, 22*b*, 22*c*.

The sterilization of the vessels 22*a*, 22*b*, 22*c*, coupled with the fact that the cleaning reservoir 20 remains sealed, allows for sterile vessels 22*a*, 22*b*, 22*c* to be held in a sterile state for some time, which is particularly useful for parents of infants who may have insufficient time to clean, rinse and sanitize bottles frequently.

It is therefore possible to provide a compact ultrasonic cleaning apparatus particularly suited to the cleaning, rinsing and sterilizing of vessels such as infant bottles, which is compact and can be used simply and easily without the user needing to undertake multiple steps.

The invention claimed is:

1. An ultrasonic cleaning apparatus comprising:

a cleaning reservoir having a fluid inlet configured to supply cleaning fluid into the cleaning reservoir, and first and second chambers, wherein the first chamber is fluidly interconnectable with the second chamber via a fluid port having a valve;

at least one ultrasonic generator;

an air suction pump connected to the second chamber and operable to create a vacuum pressure in the second chamber and thereby generate a pressure differential between the first chamber and the second chamber; and a controller configured to activate the air suction pump and close and open the valve in the fluid port, wherein the cleaning fluid is introduced into the cleaning reservoir via the fluid inlet and transferred from the first chamber into the second chamber through the fluid port with the valve open due to the pressure differential generated by the air suction pump.

2. An ultrasonic cleaning apparatus as claimed in claim 1, which further comprises at least one conduit having an open end which extends into the cleaning reservoir; and an air extraction means associated with the at least one conduit for providing an air escape pathway via the open end to remove air trapped in an inverted vessel to be cleaned when positioned on the at least one conduit inside the cleaning reservoir.

3. An ultrasonic cleaning apparatus as claimed in claim 2, wherein the at least one conduit comprises a plurality of conduits.

4. An ultrasonic cleaning apparatus as claimed in claim 3, wherein at least one of the conduits is provided in each of the first and second chambers.

5. An ultrasonic cleaning apparatus as claimed in claim 3, wherein the open ends of the conduits are vertically displaced relative to one another in the cleaning reservoir.

6. An ultrasonic cleaning apparatus as claimed in claim 2, wherein the air extraction means comprises a suction generator to provide suction at the open end of the at least one conduit to remove air from the inverted vessel.

7. An ultrasonic cleaning apparatus as claimed in claim 2, wherein the air extraction means comprises an air vent which is positioned at or adjacent a top side of the ultrasonic cleaning apparatus to permit gravitational expulsion of air during filling of the cleaning reservoir with cleaning fluid.

8. An ultrasonic cleaning apparatus as claimed in claim 2, further comprising a retaining member which is insertable into the cleaning reservoir and which is contactable with the inverted vessel to be cleaned to inhibit lift of the inverted vessel from the at least one conduit.

9. An ultrasonic cleaning apparatus as claimed in claim 8, further comprising a biasing element associated with the retaining member and which is positioned to correspond with the at least one conduit.

10. An ultrasonic cleaning apparatus as claimed in claim 2, further comprising a steam generator for generating steam to sterilise the inverted vessel to be cleaned following ultrasonic cleaning.

11. An ultrasonic cleaning apparatus as claimed claim 2, wherein a steam generator is associated with the at least one conduit, the steam generated by the steam generator being directed through the at least one conduit into the inverted vessel to be cleaned.

12. An ultrasonic cleaning apparatus as claimed in claim 1, further comprising a cleaning fluid tank for storing cleaning fluid prior to distribution into the cleaning reservoir, and a used fluid tank for storing cleaning fluid removed from the cleaning reservoir following ultrasonic cleaning.

13. An ultrasonic cleaning apparatus as claimed in claim 1, further comprising a lid having a seal to air-tightly seal the cleaning reservoir.

14. An ultrasonic cleaning apparatus as claimed in claim 13, further comprising a fill-status sensor associated with the cleaning reservoir.

* * * * *